US005765405A

United States Patent [19]

Jung et al.

[11] Patent Number: 5,765,405

[45] Date of Patent: Jun. 16, 1998

[54] AGITATOR FOR A CLOTHES WASHER HAVING A VERTICALLY RECIPROCABLE ROD FOR PREVENTING ENTANGLEMENT OF CLOTHES

[75] Inventors: Byung Don Jung, Incheon; Hee Bok Sun, Sungnam, both of Rep. of Korea

[73] Assignee: Samsung Electronics Co., Ltd., Suwon, Rep. of Korea

[21] Appl. No.: 630,328

[22] Filed: Apr. 10, 1996

[30] Foreign Application Priority Data

Apr. 12, 1995 [KR] Rep. of Korea ..... 95-7279

[51] Int. Cl.[6] ..... D06F 17/08; D06F 17/10

[52] U.S. Cl. ..... 68/133; 68/134; 74/96; 74/127

[58] Field of Search ..... 68/131, 133, 134; 74/96, 127

[56] References Cited

U.S. PATENT DOCUMENTS

| | | | |
|---|---|---|---|
| 4,193,275 | 3/1980 | Bochan | 68/134 |
| 4,452,054 | 6/1984 | Hafstrom | 68/134 X |
| 4,520,638 | 6/1985 | Brenner | 68/133 |
| 5,473,915 | 12/1995 | Hur et al. | 68/134 |

FOREIGN PATENT DOCUMENTS

3/22195 3/1991 Japan .

*Primary Examiner*—Philip R. Coe

*Attorney, Agent, or Firm*—Burns, Doane, Swecker & Mathis, L.L.P.

[57] ABSTRACT

A clothes washing machine includes a washing basket and an oscillating agitator disposed at a bottom of the washing basket. The agitator includes a plate having radial blades, and an upward guide fixed at a center of the plate. A reciprocable member is mounted on the guide for upward and downward movement relative thereto for preventing the clothes from becoming entwined. The guide includes a first screw thread which engages a second screw thread on the reciprocable member so that upward and downward forces are alternatively applied to the reciprocable member in response to relative rotation between the first and second screw threads, causing the reciprocable member to reciprocate up and down. The upward force terminates in response to a lower end of the second screw thread reaching an upper end of the first screw thread. The downward force terminates in response to an upper end of the second screw thread reaching a lower end of the first screw thread.

5 Claims, 9 Drawing Sheets

AGITATOR FOR A CLOTHES WASHER HAVING A VERTICALLY RECIPROCABLE ROD FOR PREVENTING ENTANGLEMENT OF CLOTHES

BACKGROUND OF THE INVENTION

The present invention concerns an agitator for agitating water and clothes in a clothes washing machine which comprises a water container enclosed in a housing for holding water, a washing basket mounted in the water container for holding clothes, an agitator mounted on the bottom of the washing basket for agitating water and clothes, and a motor for rotating the agitator and the washing basket in alternate directions.

Conventionally, there have been used two kinds of agitators, one of which is a pulsation type comprised of a disk-shaped washing plate rotating in alternate directions to wash clothes, as shown in FIG. 8, and a other is a perturbation type comprised with a centrally projected rod, as shown in FIG. 9.

Referring to FIG. 8, a washing machine with a pulsation type agitator comprises a water container 11 enclosed in a housing 10 for containing water, a washing basket 12 rotatably mounted in the water container 11, and an agitator 1 with a plurality of blades mounted on the bottom of the washing basket 12 and rotated in alternate directions. Mounted beneath the water container 11 are a motor 14 and a power transfer device 15 to rotate the agitator 1 and the washing basket 12. The power of the motor 14 is transferred through the shaft of the power transfer device 15 to the agitator 1 and the washing basket 12. Also provided below the water container is a discharge hose 16 for discharging the waste water out from the housing 10. In operation, clothes are put into the washing basket 12 and water into the water container 11, and then the motor 14 is supplied with power to rotate the agitator 1 in alternate directions, so that the clothes and water are agitated.

In such conventional washing machine, the agitator rotates in alternate directions and induces the water flow to regularly change in direction resulting in serious twisting or entangling of the clothes. Hence, the performance of the washing machine is reduced. Namely, the twisting or entangling of the clothes causes the clothes to be irregularly distributed in the washing basket, so that the clothes are not uniformly washed.

On the other hand, the perturbation type agitator 1A as shown in FIG. 9, which is disclosed in Japanese Laid-Open Patent Publication No. 91-22195, comprises a centrally projected hollow rod 2 having a screw-threaded hole (not shown) formed therein, and a vertically moveable stirrer 5 mounted on the upper part of the rod 2. The stirrer includes a screw-threaded stem (not shown) extending into the rod 2 and connected to the hole. In operation, as the agitator 1A is rotated in opposite directions, the stirrer 5 vertically reciprocates preventing the clothes from being twisted or entangled. The stem is threaded along its entire length so that it never becomes uncoupled from the threaded hole.

In this conventional type, because the stirrer is mounted near the surface of the water, it is difficult to reverse the rotational direction of the agitator. Moreover, the stirrer does not deeply come into the lower part of the water, so that the regular water flow cannot be completely destroyed so as to effectively prevent the clothes from twisting or entangling. In addition, when the clothes often enter the gap between the rod and the stirrer, they can be damaged.

SUMMARY OF THE INVENTION

It is an object of the present invention to provide a reciprocable member for preventing clothes in a washing machine from twisting or entangling.

It is another object of the present invention to provide means for preventing excessive force from being applied to the upper and lower ends of the reciprocable member.

According to an embodiment of the present invention, a clothes washing machine comprises a water container enclosed in a housing for holding water, a washing basket mounted in the water container for holding clothes, an agitator mounted on the bottom of the washing basket for agitating water and clothes, and a motor for rotating the agitator and the washing basket in alternate directions, wherein the agitator comprises a rotating blade for rotating about a central shaft in the alternate directions for agitating the water and the clothes, a cylindrical guide member concentrically and fixedly attached to the rotating blade so as to rotate integrally with the rotating blade, a rotating blade guide concentrically arranged with the cylindrical guide member so as to reciprocate vertically as well as to rotate, and a reciprocating guide means arranged between the cylindrical guide member and the rotating blade guide for enabling the rotating blade guide to reciprocate vertically according to the rotation of the rotating blade in the alternate directions and to lose the ascending or falling moment respectively at the upper or lower dead center.

The present invention will now be described more specifically with reference to the drawings attached only by way of example.

DETAILED DESCRIPTION OF PREFERRED EMBODIMENTS

Figure 1:
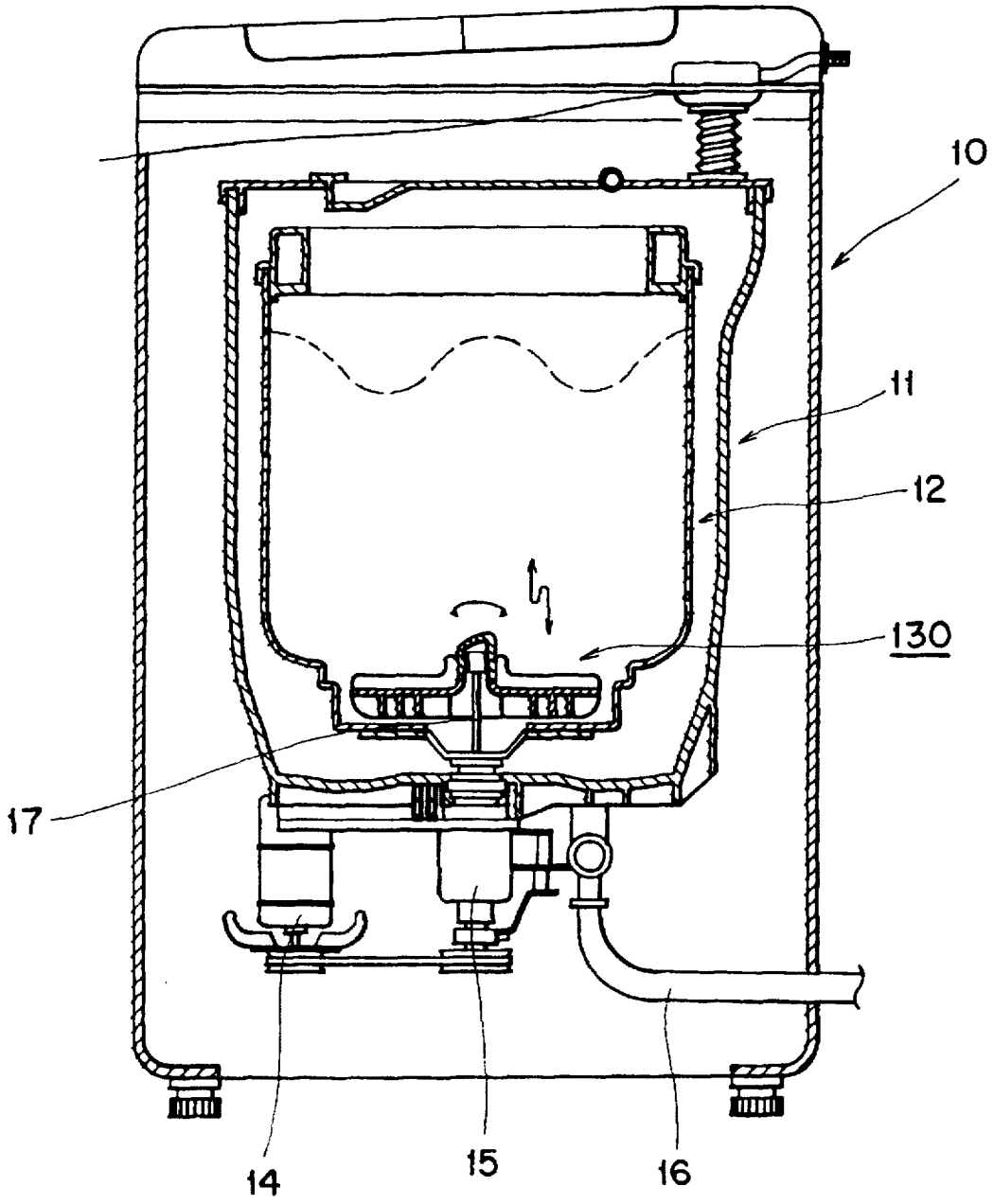
FIG. 1 is a schematic vertical sectional view of a washing machine including a pulsation type agitator according to an embodiment of the present invention.

Referring to FIG. 1, a housing 10 encloses a water container 11 for containing water. A washing basket 12 is mounted in the water container 11, and has a pulsation type agitator 130 mounted rotatably in alternate directions on the bottom of the basket 12. Provided under the water container 11 are a motor 14 and a power transfer device 15 for transferring the power of the motor through a shaft 17 to the agitator 130 and the washing basket 12. Also provided below the water container 11 is a discharge hose 16 for discharging waste water out from the housing 10.

Figure 2:
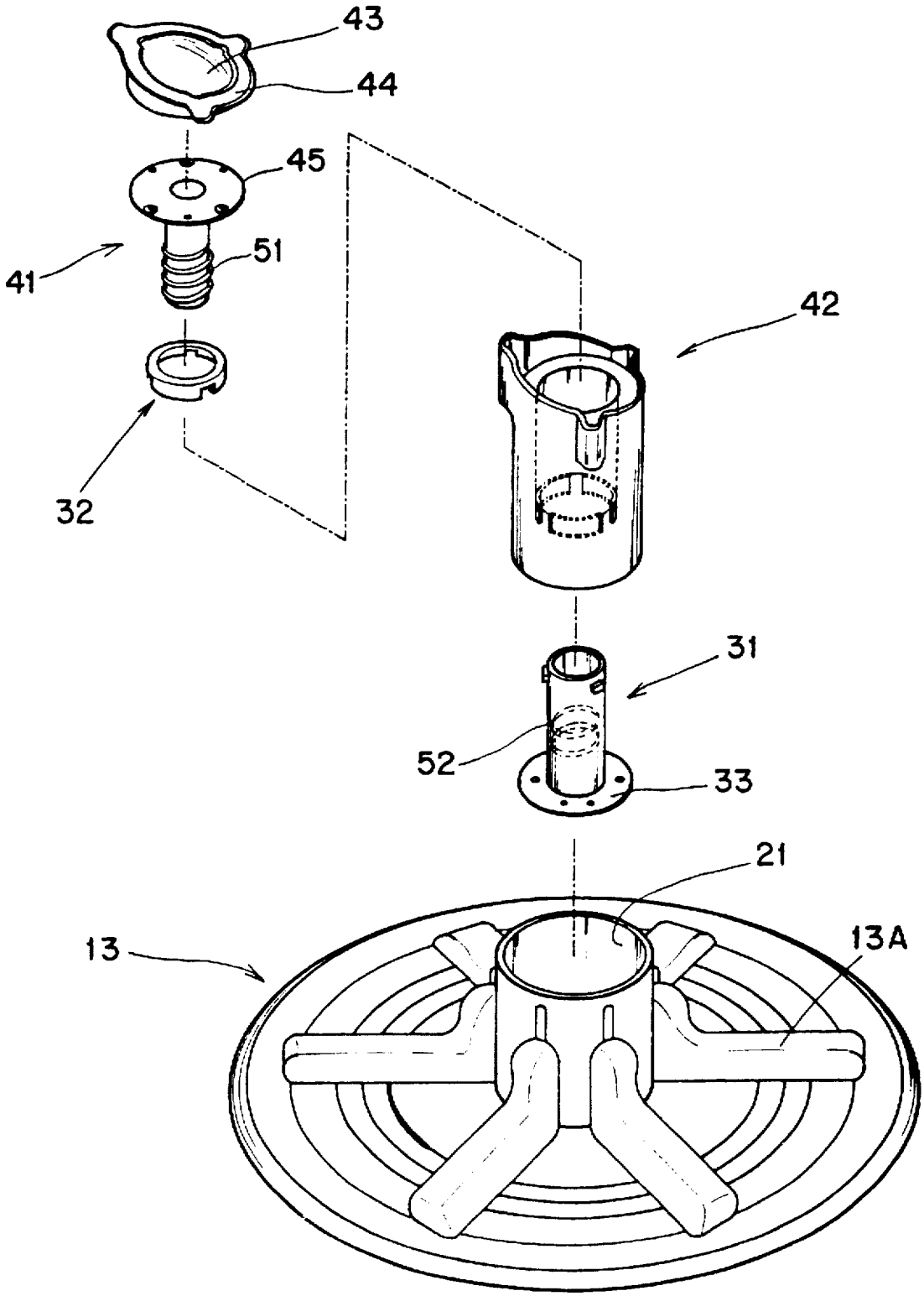
FIG. 2 is an exploded perspective view of the agitator of FIG. 1.
Figure 3:
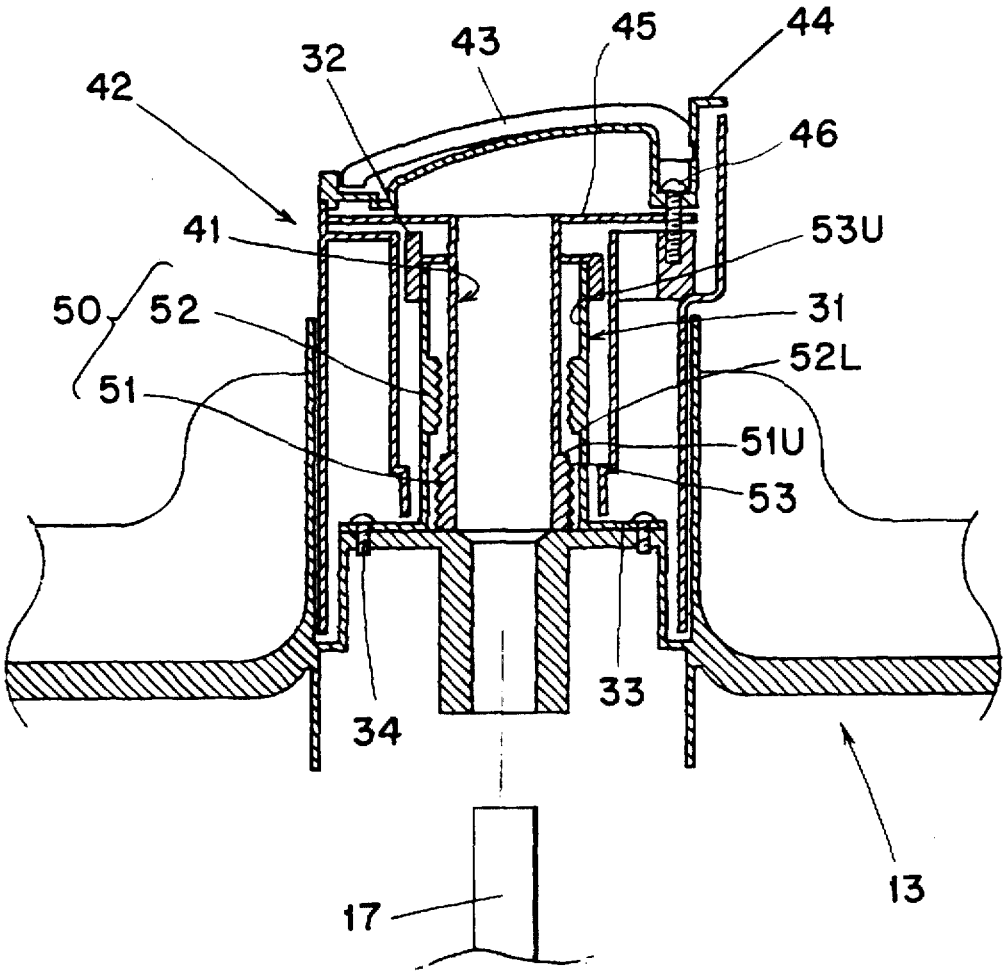
FIG. 3 is an enlarged vertical sectional view of the agitator of FIG. 1 with the rotating blade guide positioned down.
Figure 4:
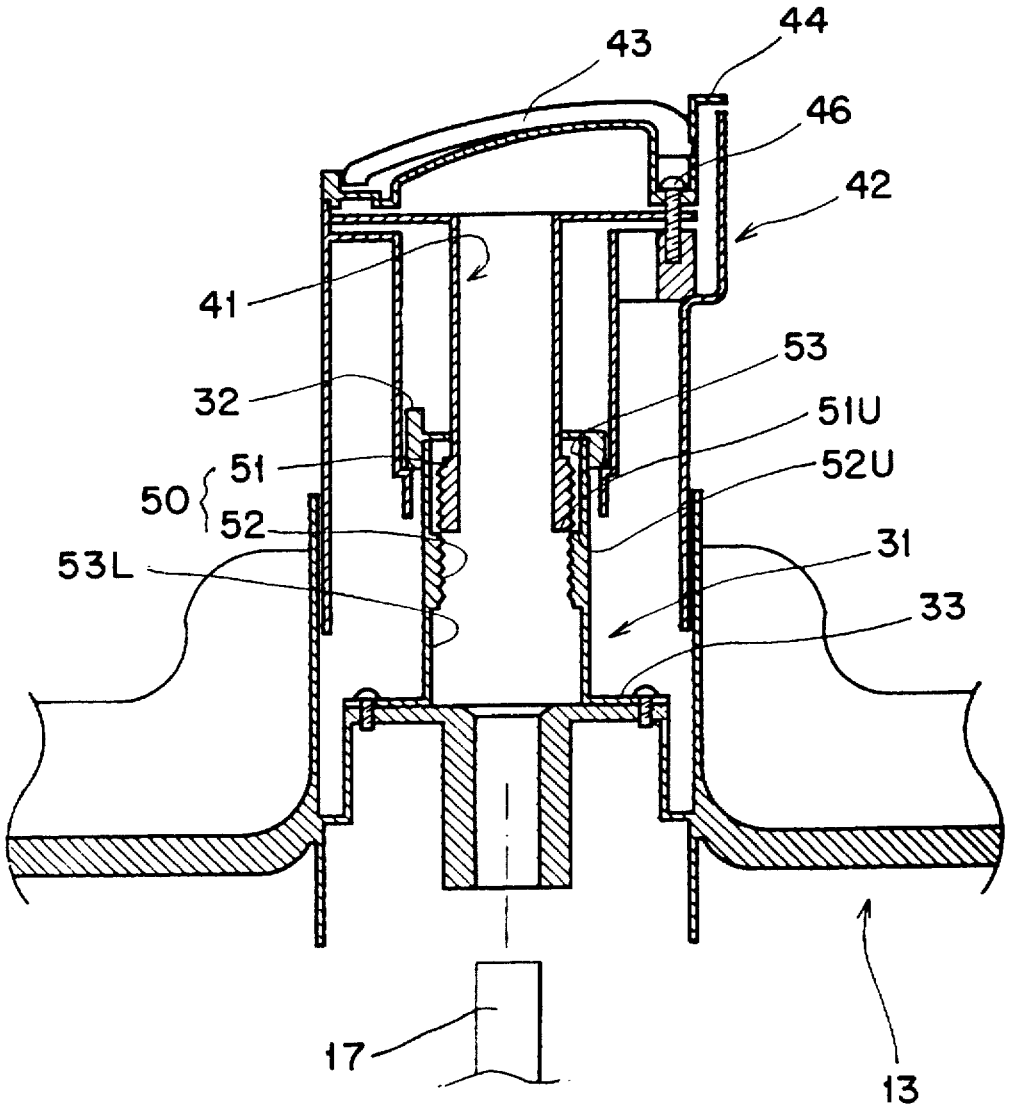
FIG. 4 is a view similar to FIG. 3 but with the rotating blade guide positioned up.

The pulsation type agitator 130, as shown in FIGS. 2 to 4, includes a rotating blade plate 13 having generally radial blades 13A. The plate 13 includes a mounting hole 21 formed in the rotational center of the rotating blade plate 13. The mounting hole 21 receives a cylindrical guide member 31 concentrically and fixedly attached to the rotating blade plate 13 so as to rotate integrally with the rotating blade plate 13, and a reciprocating member 41 coaxially arranged in the cylindrical guide member 31 so as to reciprocate vertically as well as to rotate as with the cylindrical guide member 31. An outer sleeve 42 is attached to the reciprocating member 41.

The cylindrical guide member 31 is opened at both ends with the lower end fixedly attached to the rotating blade plate 13. Namely, the cylindrical guide member 31 has an outward flange 33 at the lower end, which is fixed to the rotating blade plate 13 by means of a plurality of screws 34. The reciprocating member 41 is made of a material with a buoyancy, and inserted into the cylindrical guide member 31 with the upper end projected through the upper end of the cylindrical guide member. The member 41 is rotatably and vertically movable relative to the cylindrical guide member 31.

A reciprocating guide device 50 is arranged between the cylindrical guide member 31 and the reciprocating member 41 for enabling the reciprocating member 41 to reciprocate vertically according to the rotation of the cylindrical guide member 31 in alternate directions. The reciprocating guide device 50 comprises a male threaded portion 51 formed on the outer surface of a lower portion of the reciprocating member 41 and a female threaded portion 52 formed on a portion of the inside of the cylindrical guide member 31 to engage with the male threaded portion 51. The female threaded portion 52 is provided at a vertically intermediate portion of the cylindrical guide member 31, so that the inside of the cylindrical guide member 31 has wide release portions 53U and 53L above and below the female threaded portion 52 to release the male threaded portion 51 from engagement with the female portion 52 at said upper and lower dead centers. When the rotating sleeve 42 goes to the upper dead center as shown in FIG. 4, the lower end 51L of the male threaded portion 51 contacts the upper end 52U of the female threaded portion 52.

A stopping member 32 is provided, as shown in FIG. 4, at the upper end of the cylindrical guide member 31 to prevent the rotating sleeve 42 from going off upwardly off the cylindrical guide member 31. The reciprocating member 41 has an outward flange 45, to which the rotating sleeve 42 including the reciprocating member 41 is fixedly attached by means of a plurality of screws 46. Detachably mounted on the upper end of the rotating sleeve 42 are an inclined cap 43 and a cap guide 44 for receiving the cap 43 to reduce the load exerted to the rotating sleeve 42 while reciprocating. The cap 43 serves to guide the water along the inclined surface down to the washing basket 12 and to prevent the clothes from being jammed. The flange 45, rotating sleeve 42, and cap guide 44 are connected together by means of the plurality of screws 46.

In operation, when the motor 14 is turned on after the washing basket 12 is filled with clothes and the water container with water, the power transfer device 15 changes the power of the motor into a proper speed transferred to the agitator 130 for rotating the agitator in alternate directions. In this case, a tendency the clothes to be twisted or entangled by the water flow regularly reversed by the agitator 130 is prevented by the rotating sleeve 42, which reciprocates while rotating so as to disrupt the water flow, thus causing turbulence in the water flow.

FIG. 3 represents the rotating sleeve 42 positioned at the bottom dead center just before starting the washing operation, and FIG. 4 at the upper dead center. The rotating sleeve 42 including the reciprocating member 41 is positioned at the bottom dead center due to the weight of the clothes just before starting the washing operation, as shown in FIG. 3. When water is supplied to the water container 11, the rotating sleeve 42 rises upwards by the afore-mentioned buoyancy of the reciprocating member 41, so that the lower end 52L of the female threaded portion 52 contacts the upper end 51U of the male threaded portion 51. The rotating plate 13 rotates to agitate the water and clothes. The rotating sleeve 42 is impeded by the clothes so as to rotate at a lower speed than the rotational speed of the rotating plate 13, so that the reciprocating member 41 connected with the rotating sleeve 42 has the upper end 51U of the male threaded portion 51 engaged with the lower end 52L of the female threaded portion 52 during rotation of the agitator in one direction the reciprocating member 41 is extended upwardly. When the reciprocating member 41 is raised to the upper dead center, the male and female threaded portions 51 and 52 are released from each other, so that the male threaded portion 51 rotates idly in the flat release portion 53U. Hence, the ascending force ceases to be applied to the reciprocating member 41.

Meanwhile, the lower end 51L of the male threaded portion 51 formed in the reciprocating member 41 keeps contacting the upper end 52U of the female threaded portion 52 formed in the cylindrical guide member 31 due to the weight of the clothes, as shown in FIG. 4. In this state, when the rotating blade plate 13 is rotated reversely along with the cylindrical guide member 31, the male threaded portion 51 of the reciprocating member 41 again engages with the female threaded portion 52, thus downwardly retracting the reciprocating member 41. When the reciprocating member 41 has completely descended, the male threaded portion 51 is disengaged from the female threaded portion 52 and then positioned in the flat release portion 53L. In this way, as the rotating blade plate 13 is rotated in alternate directions, the reciprocating member 41 repeatedly reciprocates, thus disturbing the regular water flow so as to form turbulent water flows, which prevents the clothes from twisting or entangling.

Figure 5:
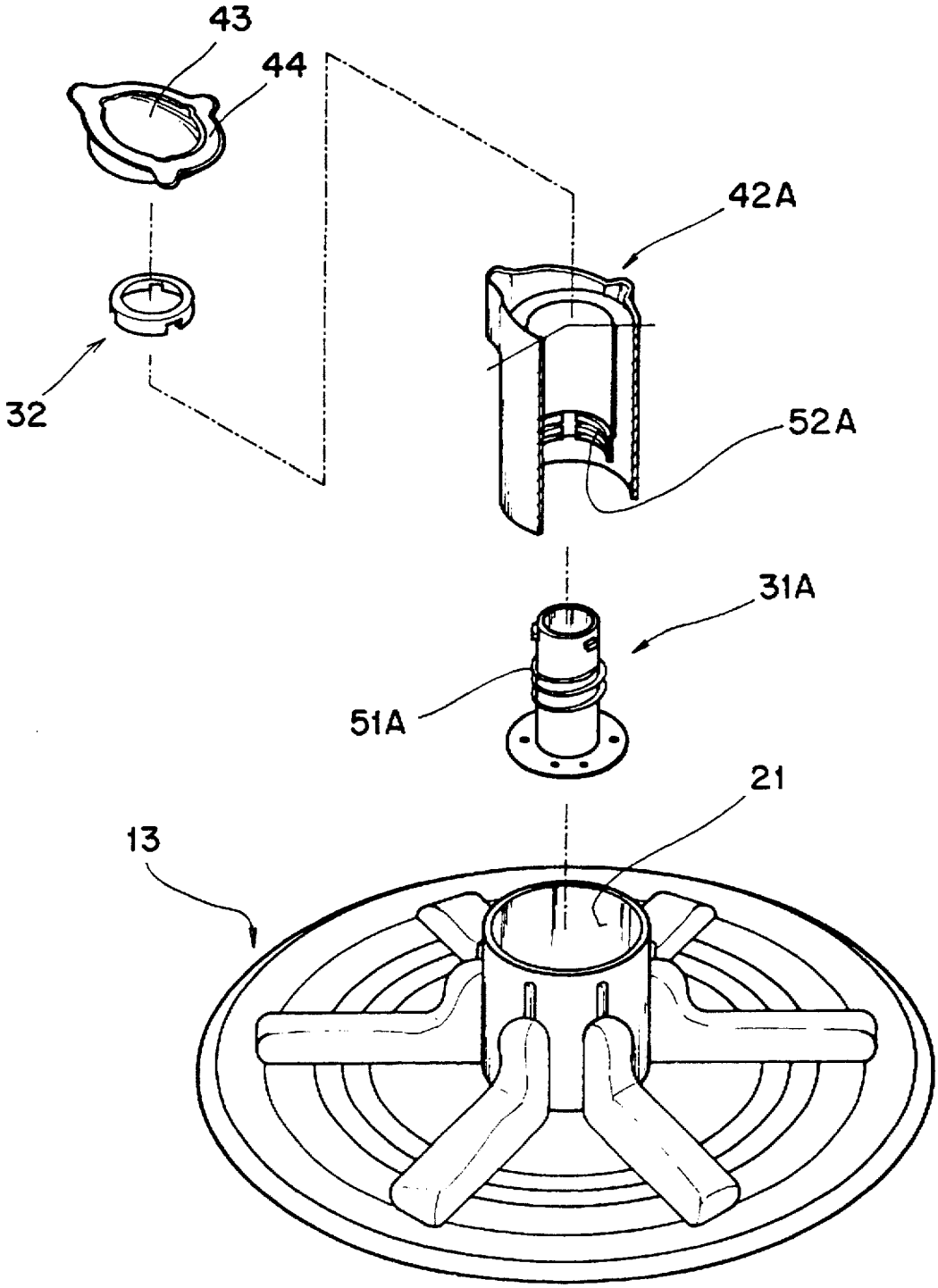
FIG. 5 is a view similar to FIG. 2 according to another embodiment of the present invention.
Figure 6:
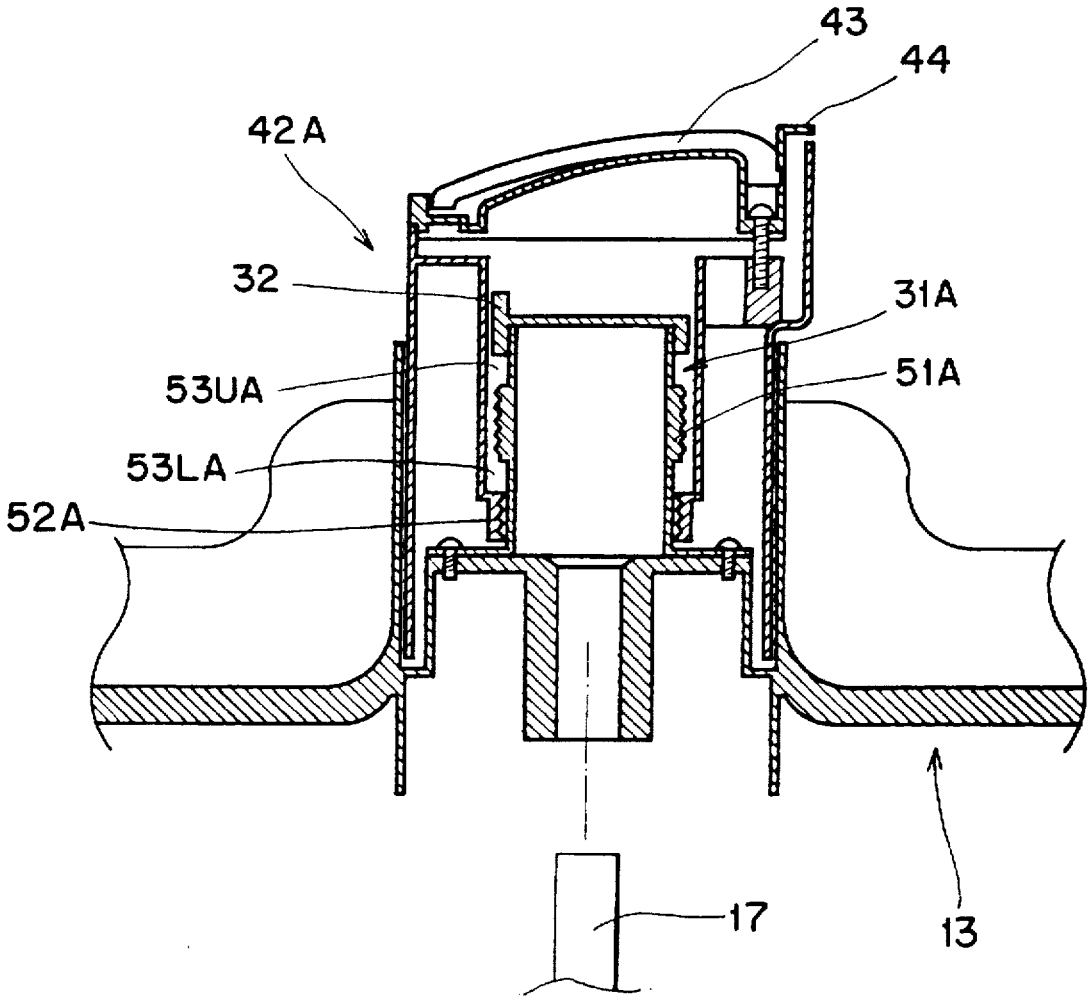
FIG. 6 is an enlarged vertical sectional view of the agitator of FIG. 5 with the rotating blade guide positioned down.
Figure 7:
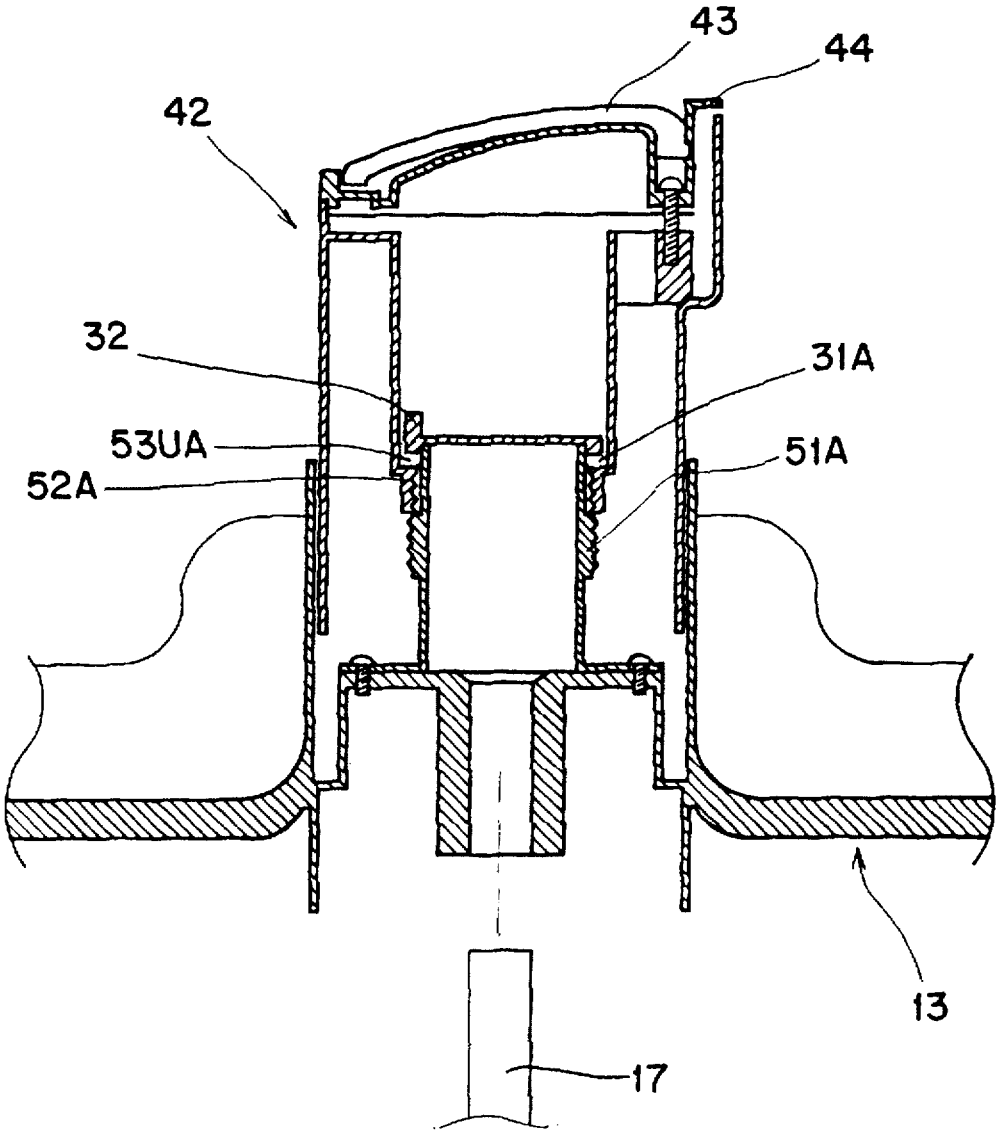
FIG. 7 is a view similar to FIG. 6 but with the rotating blade guide positioned up.
Figure 8:
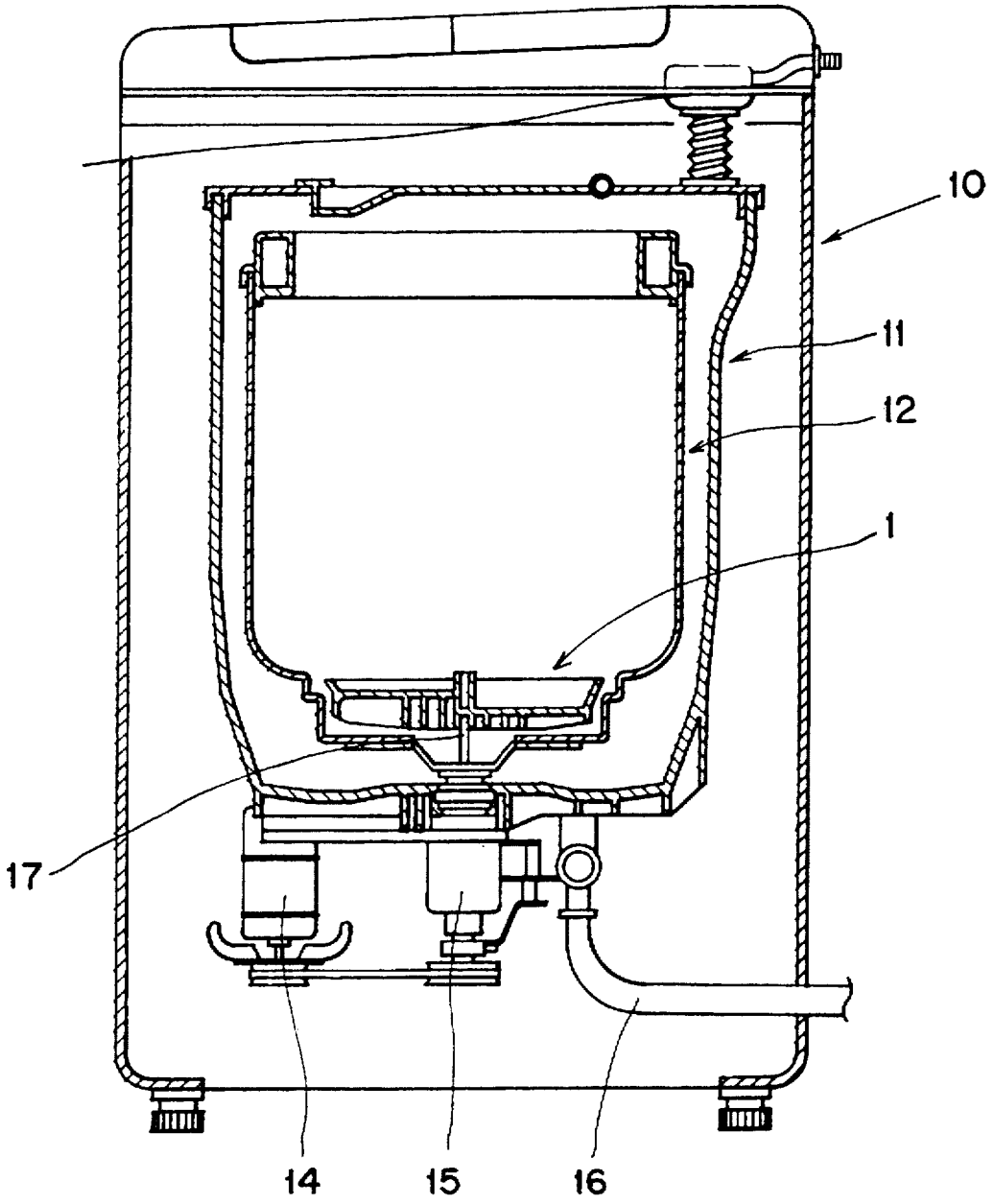
FIG. 8 (PRIOR ART)
FIG. 8 is a schematic vertical sectional view of a washing machine including a conventional agitator with a rotating blade.
Figure 9:
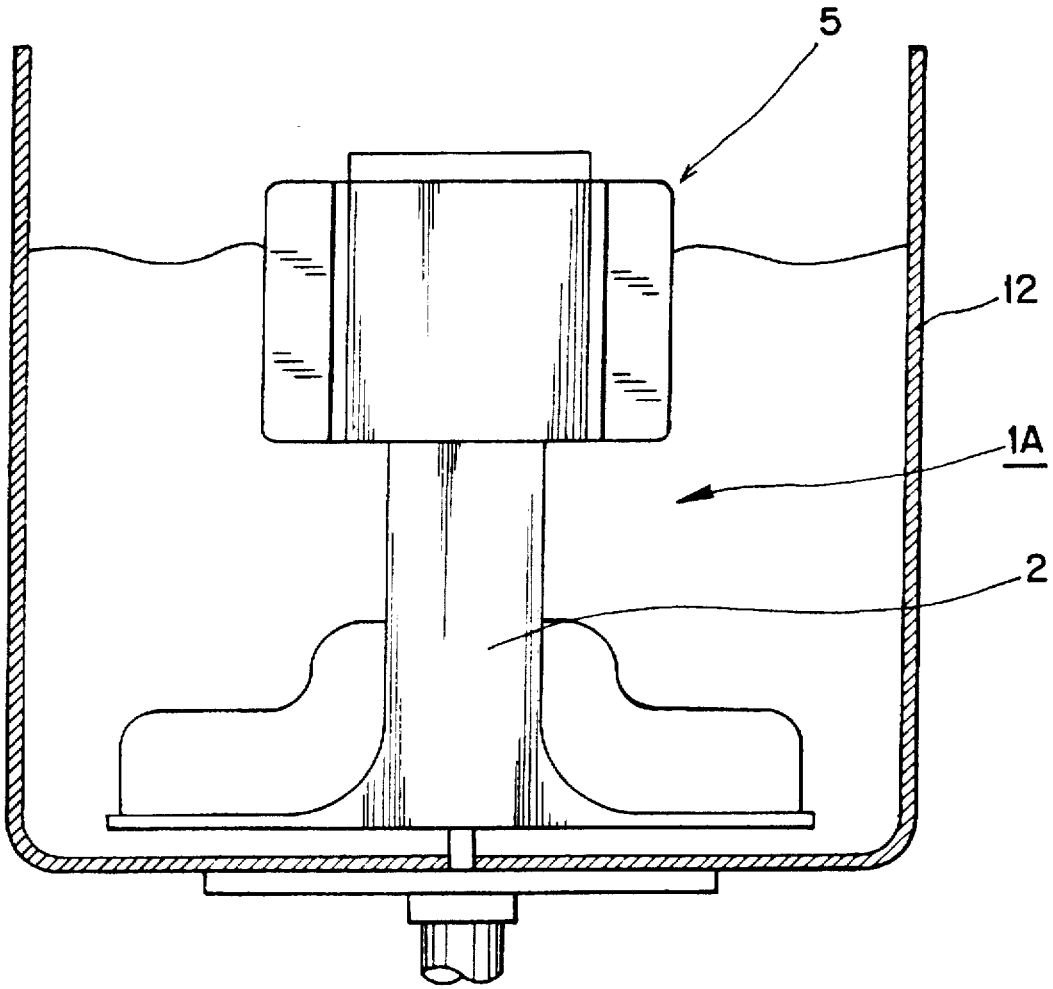
FIG. 9 (PRIOR ART)
FIG. 9 is a schematic vertical sectional view of a conventional perturbation type agitator.

According to another embodiment of the present invention as shown in FIG. 5, the male threaded portion 51A may be formed on the outside of the cylindrical guide member 31A, and the female threaded portion 52A on the inside of the rotating sleeve 42A. FIG. 6 represents the rotating sleeve 42A positioned at the bottom dead center, and FIG. 7 at the upper dead center, which is similar to the previous embodiment.

As described above, the inventive agitator causes the rotating sleeve to reciprocate vertically as the rotating blade rotates in alternate directions, so that the clothes are prevented from twisting or entangling, thus improving the washing performance. In addition, the rotating blade plate rotating near the bottom of the washing basket serves to rub the clothes enhancing the washing efficiency. Moreover, since the rotating sleeve is projected upwards from the center of the bottom of the washing basket, the clothes on one side of the washing basket are prevented from entering the other side, and thus the twisting or entangling of the clothes is prevented. Further, the inclined surface of the cap of the rotating sleeve changes the direction of the water flowing on the inclined surface as the rotating sleeve rotates, so as to induce turbulent water flows in the washing basket, thus improving the washing efficiency. Also, the flat release portions provided above and below the threaded portion of the cylindrical guide member eliminate the ascending or descending force of the reciprocating member at the upper or bottom dead center,to prevent failure of the parts of the agitator due to excessive ascending or descending of the reciprocating member.

What is claimed is:

1. A clothes washing machine comprising:

a water container;

a washing basket rotatably mounted in the water container;

an agitator disposed in the washing basket for rotation in opposite directions about an axis, the agitator including:

a plate rotatable in alternating directions and including generally radially extending agitating blades, and a reciprocable member mounted to the plate for upward and downward movement relative thereto along the axis, the reciprocable member being rotatable relative to the plate as the reciprocable member moves up and down; and a drive mechanism interconnecting the plate and the reciprocable member for converting a rotation of the plate in a first direction of rotation into an upward force applied to the reciprocable member for forcing the reciprocable member upwardly, and for converting a rotation of the plate in a second direction of rotation into a downward force applied to the reciprocable member for forcing the reciprocable member downwardly;

the drive mechanism arranged to be uncoupled from the reciprocable member in response to the reciprocable member rising to a predetermined level during rotation of the plate in the first direction, and arranged to be uncoupled from the reciprocable member in response to the reciprocable member descending to a predetermined level during rotation of the plate in the second direction of rotation;

wherein the plate includes a vertical first guide fixed thereto, and the reciprocable member includes a vertical second guide fixed thereto; the drive mechanism including first and second screw threads, the first screw thread formed on the first guide and terminating short of upper and lower ends thereof, the second screw thread formed on the second guide and terminating short of upper and lower ends thereof; the first and second screw threads being engageable with one another for applying upward and downward forces to the reciprocable member in response to relative rotation between the first and second screw threads; the upward force terminating in response to a lower end of the second screw thread reaching an upper end of the first screw thread; the downward force terminating in response to an upper end of the second screw thread reaching a lower end of the first screw thread.

2. The clothes washing machine according to claim 1 wherein the first screw thread constitutes a female screw thread, and the second screw thread constitutes a male screw thread.

3. The clothes washing machine according to claim 1 wherein the first screw thread constitutes a male screw thread, and the second screw thread constitutes a female screw thread.

4. The clothes washing machine according to claim 1 wherein the reciprocable member includes a top surface which is inclined relative to a horizontal plane.

5. The clothes washing machine according to claim 4 wherein the top surface constitutes a surface of a separate cap member.

* * * * *